US010767517B2

(12) United States Patent
Elendt et al.

(10) Patent No.: US 10,767,517 B2
(45) Date of Patent: Sep. 8, 2020

(54) VARIABLE VALVE DRIVE OF A COMBUSTION PISTON ENGINE

(71) Applicant: Schaeffler Technologies AG & Co. KG, Herzogenaurach (DE)

(72) Inventors: Harald Elendt, Altendorf (DE); Dimitri Schott, Wachenroth (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/481,848

(22) PCT Filed: Jan. 24, 2018

(86) PCT No.: PCT/DE2018/100053
§ 371 (c)(1),
(2) Date: Jul. 30, 2019

(87) PCT Pub. No.: WO2018/141332
PCT Pub. Date: Aug. 9, 2018

(65) Prior Publication Data

US 2019/0376420 A1 Dec. 12, 2019

(30) Foreign Application Priority Data

Jan. 31, 2017 (DE) ..... 10 2017 101 792

(51) Int. Cl.
*F01L 1/18* (2006.01)
*F01L 1/24* (2006.01)
(Continued)

(52) U.S. Cl.
CPC ..... *F01L 1/185* (2013.01); *F01L 1/2405* (2013.01); *F01L 13/065* (2013.01);
(Continued)

(58) Field of Classification Search
CPC ..... F01L 1/053; F01L 1/185; F01L 2001/186; F01L 1/2405; F01L 1/267; F01L 1/46;
(Continued)

(56) References Cited

U.S. PATENT DOCUMENTS 4,523,550 A * 6/1985 Honda ..... F01L 1/267 123/308
5,544,626 A 8/1996 Diggs et al.
(Continued)

FOREIGN PATENT DOCUMENTS

DE 19930573 A1 1/2001
DE 10137490 A1 2/2003
(Continued)

*Primary Examiner* — Jorge L Leon, Jr.
(74) *Attorney, Agent, or Firm* — Matthew Evans

(57) ABSTRACT

The invention relates to a variable valve drive of an internal combustion engine, comprising at least one functionally identical gas exchange valve per cylinder, the valve stroke of which is specified by at least one primary cam and at least one secondary cam of a camshaft. The valve stroke can be selectively transmitted to the at least one gas exchange valve by a switchable cam follower which has a primary lever and a secondary lever. A coupling element of the switchable cam follower is designed as a coupling pin which is guided in a transverse bore of the primary follower, which can be moved into an opposite coupling bore of the secondary lever by a switching pin. An outer end of the switching pin is connected to a switching rod via a connecting element, the switching rod arranged parallel to the camshaft and longitudinally movable by an actuator.

20 Claims, 10 Drawing Sheets

(51) Int. Cl.

| | |
|---|---|
| *F01L 13/06* | (2006.01) |
| *F01L 1/047* | (2006.01) |
| *F01L 1/053* | (2006.01) |
| *F01L 13/00* | (2006.01) |

(52) U.S. Cl.
CPC ..... *F01L 2001/0476* (2013.01); *F01L 2001/0537* (2013.01); *F01L 2013/101* (2013.01)

(58) Field of Classification Search
CPC ..... F01L 13/0005; F01L 13/0036; F01L 2800/06; F01L 2820/031
USPC ..... 123/90.16, 90.17, 90.2, 90.27, 90.39, 123/90.41, 90.43, 90.44, 90.46
See application file for complete search history.

(56) References Cited

U.S. PATENT DOCUMENTS

| | | | | |
|---|---|---|---|---|
| 6,499,451 | B1* | 12/2002 | Hendriksma | F01L 1/08 123/198 F |
| 2001/0045197 | A1* | 11/2001 | Fernandez | F01L 1/182 123/90.39 |
| 2003/0154941 | A1* | 8/2003 | Hendriksma | F01L 1/18 123/90.16 |
| 2011/0226206 | A1* | 9/2011 | Riley | F01L 13/0021 123/90.39 |
| 2011/0271917 | A1* | 11/2011 | Ezaki | F01L 13/0036 123/90.1 |
| 2012/0006291 | A1* | 1/2012 | Nishikiori | B60W 10/06 123/90.15 |
| 2012/0055428 | A1* | 3/2012 | Kidooka | F01L 1/267 123/90.16 |
| 2013/0298856 | A1* | 11/2013 | Sugiura | F01L 13/0036 123/90.15 |
| 2018/0363518 | A1* | 12/2018 | Raimondi | F01L 1/185 |
| 2019/0063268 | A1* | 2/2019 | Buonocore | F01L 1/185 |

FOREIGN PATENT DOCUMENTS

| | | | |
|---|---|---|---|
| DE | 10212327 | A1 | 3/2003 |
| DE | 10155801 | A1 | 5/2003 |
| DE | 69923139 | T2 | 12/2005 |
| DE | 102006023772 | A1 | 11/2007 |
| DE | 102006057894 | A1 | 6/2008 |
| DE | 102011085708 | A1 | 5/2013 |
| DE | 102015221037 | A1 | 8/2016 |
| DE | 102016220859 | A1 | 9/2017 |
| EP | 2653673 | A1 | 10/2013 |
| JP | S60111010 | A | 6/1985 |
| JP | 2004108252 | A | 4/2004 |
| JP | 2004108525 | A1 | 4/2004 |

* cited by examiner

VARIABLE VALVE DRIVE OF A COMBUSTION PISTON ENGINE

CROSS REFERENCE TO RELATED APPLICATIONS

This application is the U.S. National Phase of PCT Application No. PCT/DE2018/10053 filed on Jan. 24, 2018 which claims priority to DE 10 2017 101 792.5 filed Jan. 31, 2017, the entire disclosures of which are incorporated by reference herein.

TECHNICAL FIELD

This disclosure relates to a variable valve train of a reciprocating internal combustion engine having at least one functionally identical gas exchange valve for each cylinder, whereof the valve lift is specified in each case by at least one primary cam and a secondary cam of a camshaft. The valve lift can be selectively transferred to at least one associated gas exchange valve by means of a switchable cam follower, which has a primary lever and a secondary lever. The primary lever is supported by its one end on an associated supporting element mounted on the housing side and by its other end on the valve shaft of the associated gas exchange valve. The respective primary lever is in following contact with the associated primary cam between its two ends. The secondary lever, pivotably mounted in each case on the primary lever, is in following contact with the associated secondary cam and can be coupled to the primary lever by means of a coupling element which is adjustable by an adjusting device.

BACKGROUND

Switchable valve trains of reciprocating internal combustion engines are known in various designs. In this regard, valve trains of individual cylinders or groups of cylinders of a reciprocating internal combustion engine can be deactivated by deactivating the transferrable valve lift and therefore, in conjunction with deactivating the fuel injection for the relevant cylinders, the fuel consumption and the $CO_2$ and pollutant emissions of the reciprocating internal combustion engine can be lowered in partial load operation. On the other hand, the time-based lift characteristics which can be transferred by valve trains of intake and/or exhaust valves of a reciprocating internal combustion engine can be altered by a lift switchover and therefore adapted to the current operating state of the reciprocating internal combustion engine depending on operating parameters such as the engine speed and the engine load, whereby the engine power and the torque can be increased and the specific fuel consumption of the reciprocating piston engine can be reduced.

In the case of deactivatable valve trains, two mutually relatively displaceable or rotatable components of a switchable lift transfer element are usually provided in each case, of which the one component is in adjusting communication with the associated cam of a camshaft and the other component is in adjusting communication with the valve shaft of the associated gas exchange valve. Both components can be mutually coupled or uncoupled via a coupling element, in most cases designed as a coupling pin. The valve lift of the associated cam is transferred to the relevant gas exchange valve in the coupled state, but not in the uncoupled state, which means that the gas exchange valve then remains closed. The coupling pin is usually axially movably guided in a bore of the one component and displaceable into a coupling bore of the other component. The coupling pin is held in a rest position by means of a spring element and, under the application of an adjusting force, is displaced in opposition to the restoring force of the spring element into an actuating position and retained there. In the case of deactivatable valve trains, the rest position of the coupling pin usually corresponds to the coupled state of the components of the lift transfer element and the actuating position corresponds to the uncoupled state of the components. The deactivatable lift transfer elements can be deactivatable bucket tappets, roller tappets, rocker arms, cam followers or supporting elements.

In the case of switchable valve trains, at least two mutually relatively displaceable or rotatable components of a switchable lift transfer element are provided in each case, of which the one component is coupled to an associated primary cam or a camshaft with a particular valve lift and to the valve shaft of the associated gas exchange valve, and the other component is in adjusting communication with an associated secondary cam of the camshaft with a greater valve lift or with a secondary lift. Both components can be mutually coupled or uncoupled via a coupling element, in most cases designed as a coupling pin. In the uncoupled state, the valve lift of the primary cam is transferred to the relevant gas exchange valve; in the coupled state, on the other hand, the valve lift of the secondary cam is transferred to the gas exchange valve. The coupling pin is also usually axially movably guided in a bore of the one component here and displaceable into a coupling bore of the other component. The coupling pin is held in a rest position by means of a spring element and, under the application of an adjusting force, is displaced in opposition to the restoring force of the spring element into an actuating position and retained there. In the case of switchable valve trains, the rest position of the coupling pin corresponds in most cases to the uncoupled state of the components of the lift transfer element and the actuating position corresponds to the coupled state of the components. Such switchable lift transfer elements are, for example, switchable bucket tappets, switchable rocker arms or switchable cam followers.

The adjustment of coupling elements of switchable lift transfer elements usually takes place hydraulically in that, via a solenoid switching valve, for example, a switching pressure line leading to pressure chambers of the coupling elements is alternately connected to an oil pressure source or depressurized. A known design of a switchable cam follower, which is equipped with a hydraulically adjustable coupling pin and is provided in a reciprocating internal combustion engine for lift deactivation of a gas exchange valve, is disclosed in DE 10 2006 057 894 A1. On the other hand, DE 10 2006 023 772 A1 describes a switchable cam follower with a hydraulically adjustable coupling pin, which is provided in a reciprocating internal combustion engine for lift switchover of a gas exchange valve.

If gas exchange valves of a reciprocating internal combustion engine are to be selectively deactivated or switched over in groups, separate switching pressure lines, each with an associated switching valve, are required for a hydraulic adjustment of the coupling elements. A corresponding hydraulic adjusting device for selectively adjusting the coupling elements of a variable valve train in groups in a reciprocating internal combustion engine having two intake valves and two exhaust valves for each cylinder is described, for example, in DE 102 12 327 A1.

The switchable lift transfer elements of this valve train are formed as switchable bucket tappets in this case.

However, the adjustment of coupling elements of switchable lift transfer elements can also take place electromagnetically in that the coupling elements are each in operative communication with an electromagnet, and the electromagnets are alternately energized or de-energized. A known design of a switchable cam follower, which is equipped with an electromagnetically adjustable coupling pin and is provided in a reciprocating internal combustion engine for lift deactivation of a gas exchange valve, is revealed in U.S. Pat. No. 5,544,626 A. The coupling pin and the electromagnet, the armature of which is connected to the coupling pin, are arranged lengthwise in the primary housing of the cam follower, resulting in a greater structural length of the cam followers and a correspondingly greater width of the relevant cylinder head.

On the other hand, in the non-prepublished DE 10 2016 220 859 A1, a valve train of a reciprocating internal combustion engine with electromagnetically switchable cam followers is described, which is provided in a reciprocating internal combustion engine for lift switchover of the relevant gas exchange valves. The coupling pins are each arranged lengthwise in the respective primary lever of the cam followers and can each be brought into contact with a ramp surface of an armature rod of an associated electromagnet and displaced axially into a coupling position. The electromagnets are arranged with a substantially vertical alignment above the cam followers and the associated camshaft on a carrier plate fastened to the relevant cylinder head, resulting in a greater structural height of the cylinder head.

Further switchable cam followers with coupling pins aligned parallel and transversely to the longitudinal extent thereof are known from DE 101 55 801 A1 and DE 10 2015 221 037 A1. Moreover, U.S. Pat. No. 6,499,451 B1 discloses a variable valve train of an internal combustion engine, in which the switchable cam followers associated with each valve are actuatable by means of a separate actuator in each case. In this case, these actuators each act on an arm of a two-armed pivot element, which is pivotably mounted on a shaft and whereof the second arm can act on a coupling pin of the associated cam follower. This valve train is also regarded unfavorably, mainly on account of its many separate actuators and adjusting means.

Finally, J P 2004-108 525 A1 discloses a variable valve train with a plurality of cam followers for actuating functionally identical valves of an internal combustion engine, whereof the respective adjusting device manages with only one actuator. However, the secondary levers and primary levers therein are formed separately and arranged adjacent to one another. The secondary levers can be coupled to a directly adjacent primary lever via an axial displacement of a coupling pin mounted in a transverse bore of the respective secondary lever into a coupling bore of the respective primary lever. In the coupled state, the respectively greater lift of the primary and secondary cams of a camshaft is transferred to the relevant gas exchange valves. The axial displacement of the coupling pins can only take place in each case when both cams are followed on the base circle at the same time since only then are the transverse and coupling bores flush with one another.

The actuation of the coupling pins takes place by means of an adjusting device, which has a switching rod which is arranged parallel to the camshaft of the internal combustion engine and is linearly displaceable by an actuator. For each primary lever and secondary lever pair, two axial stops are fastened to the switching rod. A guide sleeve is arranged on the switching rod between two stops in each case, which guide sleeve is displaceable between the two stops on the switching rod, spring loaded in the switching direction on one side by means of a pressure spring. An arm, which is in actuating contact with the free end face of the said coupling pin, extends in one piece from the respective guide sleeve. In this case, the respective arms of the respective guide sleeves are formed as rigid metal levers. The coupling pin can be restored into its uncoupling position by means of a pressure spring.

When the switching rod is displaced in the switching direction, the secondary levers of the currently switchable lever pairs are immediately coupled to the primary levers. The coupling pins of the currently non-switchable lever pairs are pre-tensioned with a force in the switching direction by the tension of the relevant pressure springs. The coupling of the secondary levers to the primary levers takes place in each case when the relevant two cams of the associated camshaft are followed on the base circle and the transverse and coupling bores are flush with one another.

Since the arrangement of separate hydraulic switching pressure lines or electrical switching lines in a cylinder head of a reciprocating internal combustion engine is relatively difficult and costly owing to confined space conditions, and the variable valve train known from JP 2004-108 525 A1 was regarded as too mechanically complex, the object on which the disclosure was based was to propose a variable valve train of a reciprocating internal combustion engine of the type mentioned at the outset with switchable cam followers for functionally identical gas exchange valves, which can be switched over by means of a space-saving adjusting device. To this end, only one adjusting device for the switching cam followers shall be used in each case for actuating functionally identical valves.

SUMMARY

This object is achieved in conjunction with the features described herein in that the respective coupling element of the switchable cam followers is formed in each case as a coupling pin which is axially movably guided in a transverse bore of the primary lever. By means of a switching pin the coupling pin is axially movably mounted in a transverse bore of the secondary lever. The coupling element is displaceable in opposition to the restoring force of a spring element into an opposing coupling bore of the secondary lever, in that the respective switching pin projects out of the secondary lever with its axially outer end. This axially outer end of the switching pin is connected to a rod-shaped connecting element which is in turn coupled for adjusting communication with a switching rod. The switching rod is arranged above the respective cam follower parallel to the associated camshaft. By means of a linear actuator, the switching rod is longitudinally displaceable in opposition to the restoring force of a spring element from a rest position into a switching position, and the connecting elements of the switchable cam followers are formed as leaf springs.

Advantageous configurations and further developments are also described and shown by the accompanying figures.

The disclosure accordingly starts with a variable valve train, known per se, of a reciprocating internal combustion engine, which has at least one functionally identical gas exchange valve for each cylinder. The functionally identical gas exchange valves can be intake valves or exhaust valves. The valve lift of these functionally identical gas exchange valves is specified in each case by at least one primary cam and a secondary cam of a camshaft and can be selectively transferred to at least one associated gas exchange valve by means of a switchable cam follower, which has a primary lever and a secondary lever. The primary lever is respectively supported at the ends on a supporting element mounted on the housing side and, opposite this, on the valve shaft of the associated gas exchange valve, and is in following contact with the associated primary cam inbetween, for example via a rotatably mounted roller. The secondary lever is pivotably mounted in each case on the primary lever, it is in following contact with the associated secondary cam, for example via at least one slide surface, and it can be coupled to the primary lever by means of a coupling element which is adjustable by an adjusting device. In the coupled state of the cam follower, the lift characteristic of the secondary cam, which usually has a greater lift height than the primary cam or performs a secondary lift, is transferred to the associated gas exchange valve. The secondary lift can be, for example, a subsequent lift for exhaust gas return or a decompression lift in the operating cycle for increasing the engine braking effect.

According to the disclosure, it is provided in this variable valve train that the respective coupling element of the switchable cam followers is formed in each case as a coupling pin which is axially movably guided in a transverse bore of the primary lever. By means of a switching pin, which is axially movably mounted in a transverse bore of the secondary lever, the coupling element is displaceable in opposition to the restoring force of a spring element into an opposing coupling bore of the secondary lever. The respective switching pin projects out of the secondary lever with its axially outer end, that this axially outer end of the switching pin is connected to a rod-shaped connecting element which is in turn coupled for adjusting communication with a switching rod. The switching rod is arranged above the respective cam follower parallel to the associated camshaft, and, by means of a linear actuator, the switching rod is longitudinally displaceable in opposition to the restoring force of a spring element from a rest position into a switching position. The connecting elements of the switchable cam followers, with which the switching pins thereof can be actuated, are formed as leaf springs.

As an alternative to a hydraulic switchover of the cam followers with separate switching pressure lines leading to the cam followers or an electromagnetic switchover of the cam followers with separate electrical switching lines leading to the electromagnets arranged within or outside the cam followers, to enable a switchover of the cam followers of the functionally identical gas exchange valves, the coupling elements of the switchable cam followers are each formed as a coupling pin which is axially movably guided in a transverse bore of the primary lever and, by means of a switching pin which is axially movably mounted in a transverse bore of the secondary lever, is displaceable in opposition to the restoring force of a spring element into an opposing coupling bore of the secondary lever. The transverse bores in the primary levers and the secondary levers of the cam followers and the coupling and switching pins guided therein are therefore aligned parallel to the associated camshaft. Each switching pin projects out of the secondary lever with its axially outer end and, at this end, is in adjusting communication with a switching rod via an upwardly directed rod-shaped connecting element, which switching rod is arranged above the cam followers parallel to the associated camshaft and, via a linear actuator, is longitudinally displaceable in opposition to the restoring force of a spring element from a rest position into a switching position.

According to the disclosure, the connecting elements of the switchable cam followers are formed as leaf springs so that, upon an actuatoric axial displacement of the switching rod, they then build up a pre-tensioning force on the associated switching pin when the primary lever and the secondary lever of a switching cam follower cannot currently be coupled to one another owing to their mutual position. This pre-tensioning force on the connecting element formed as a leaf spring is then reduced by an axial displacement of the associated switching pin as soon as the primary lever and the secondary lever of the switching cam follower are aligned in the correct mutual pivotal position for this.

The adjusting device having the features of the disclosure therefore has only has a single actuator by means of which the relevant switchable cam followers can be switched over from the rest position, in which the secondary lever is uncoupled from the primary lever, into the switching position in which the secondary lever is coupled to the primary lever. The linear actuator can be arranged and fastened in the longitudinal direction of the switching rod at a suitable point on the cylinder head at which the necessary space is available for this and to which the necessary supply of energy for actuation purposes can be favorably realized. Compared to an adjusting arrangement with separate hydraulic or electromagnetic actuators, which can be arranged within or outside the switchable cam followers, the adjusting arrangement according to the invention, with the purely mechanically switchable cam followers, is designed in a significantly simpler and more space-saving manner and can be produced more cost-effectively. A plurality of such adjusting devices can also be arranged on the cylinder head of a reciprocating internal combustion engine so that a plurality of groups of functionally identical gas exchange valves, such as intake valves and/or exhaust valves of all or only certain cylinders or first and second intake and/or exhaust valves in the case of a four-valve cylinder head, can be switched over selectively.

The linear actuator can be formed as an electromagnet with an armature which is axially movably guided in a coil body, which armature is rigidly connected to the switching rod. Only a two-core cable, which leads from an electronic control device to the coil of the electromagnet, is then required to control and supply energy to the linear actuator.

However, the linear actuator can also be formed as a single-acting hydraulic or pneumatic adjusting cylinder with a piston which is axially movably guided in a cylinder, which piston is rigidly connected to the switching rod. In this embodiment, an adjusting pressure line connected to the pressure chamber of the adjusting cylinder is required to control and supply energy to the linear actuator, which adjusting pressure line can be alternately connected to a pressure supply line connected to a pressure-medium source or to an unpressurized return flow or vent line via a 3/2-way solenoid switching valve connected to an electronic control device.

The switching rod can be formed as a flat rod, which is arranged parallel to the switching pins of the switchable cam followers. Owing to the wider outer walls, the switching rod has sufficient installation space for the mechanical coupling of the rod-shaped connecting elements of the switchable cam followers.

Moreover, it is thus possible to produce the switching rod simply and cost-effectively as a stamped component from a steel sheet or a light metal sheet.

The connecting elements of the switchable cam followers are each substantially rigidly fastened on the outer end of the associated switching pin and they each engage in a slot-shaped opening in the switching rod. The switchover of the cam followers via the axial displacement of the switching rod can therefore be initiated at any time and independently of the current rotational position of the associated camshaft. The switchover of the cam followers takes place immediately at those cam followers whereof the primary and secondary cams are currently followed on the base radius by the primary and secondary levers. The relevant leaf springs are pre-tensioned in the switching direction at those cam followers whereof the primary and secondary cams are currently followed outside their base circle radius, and the switchover of the relevant cam followers then takes place when the associated cams are followed on their base circle radius owing to a corresponding rotation of the camshaft.

To ensure simple assembly, it is can be provided that the leaf springs are each fastened on the switching pin in the manner of how a retaining ring is secured to a groove. A bore of the leaf spring, which is open at the ends, is placed over and engages in an annular groove arranged at the axially outer end of the respective switching pin.

To compensate the rocking movements of the cam followers and manufacturing tolerances, the transverse and longitudinal dimensions of the openings in the switching rod are preferably greater than the respective thickness and width of the leaf springs. The leaf springs can therefore move into the openings of the switching rod with little wear during operation of the reciprocating internal combustion engine. Manufacturing tolerances in the arrangement of the openings in the switching rod and the switching rod as a whole can thus be compensated in a simple manner by an increased adjustment path of the linear actuator. The adjusting device according to the invention is therefore relatively undemanding in terms of the manufacturing precision and arrangement of the components and can therefore be produced particularly cost-effectively.

At its wider outer wall which is remote from the cam followers, the switching rod is advantageously equipped with an arcuate spring clip in each opening on the switching-direction side, the free end of which spring clip projects into the relevant opening for resiliently supporting the associated leaf spring in the longitudinal direction. The leaf springs are thus resiliently and longitudinally displaceably supported in the openings of the switching rod, whereby the mechanical wear on the contact surfaces is reduced and the transfer of transverse forces to the switching pins of the cam followers is prevented.

To prevent an excursion or buckling of the switching rod under a load, the switching rod is can be axially movably guided in a plurality of guide openings of the cylinder head which are fixed in the housing.

At least some of these guide openings of the switching rod are preferably arranged in bearing covers of the associated camshaft, whereby the production thereof is greatly simplified compared to that of an arrangement in webs of the cylinder head which are fixed to the housing.

BRIEF DESCRIPTION OF THE DRAWINGS

To clarify the invention, a drawing with an exemplary embodiment accompanies the description.

DETAILED DESCRIPTION OF THE EMBODIMENTS

Figure 1:
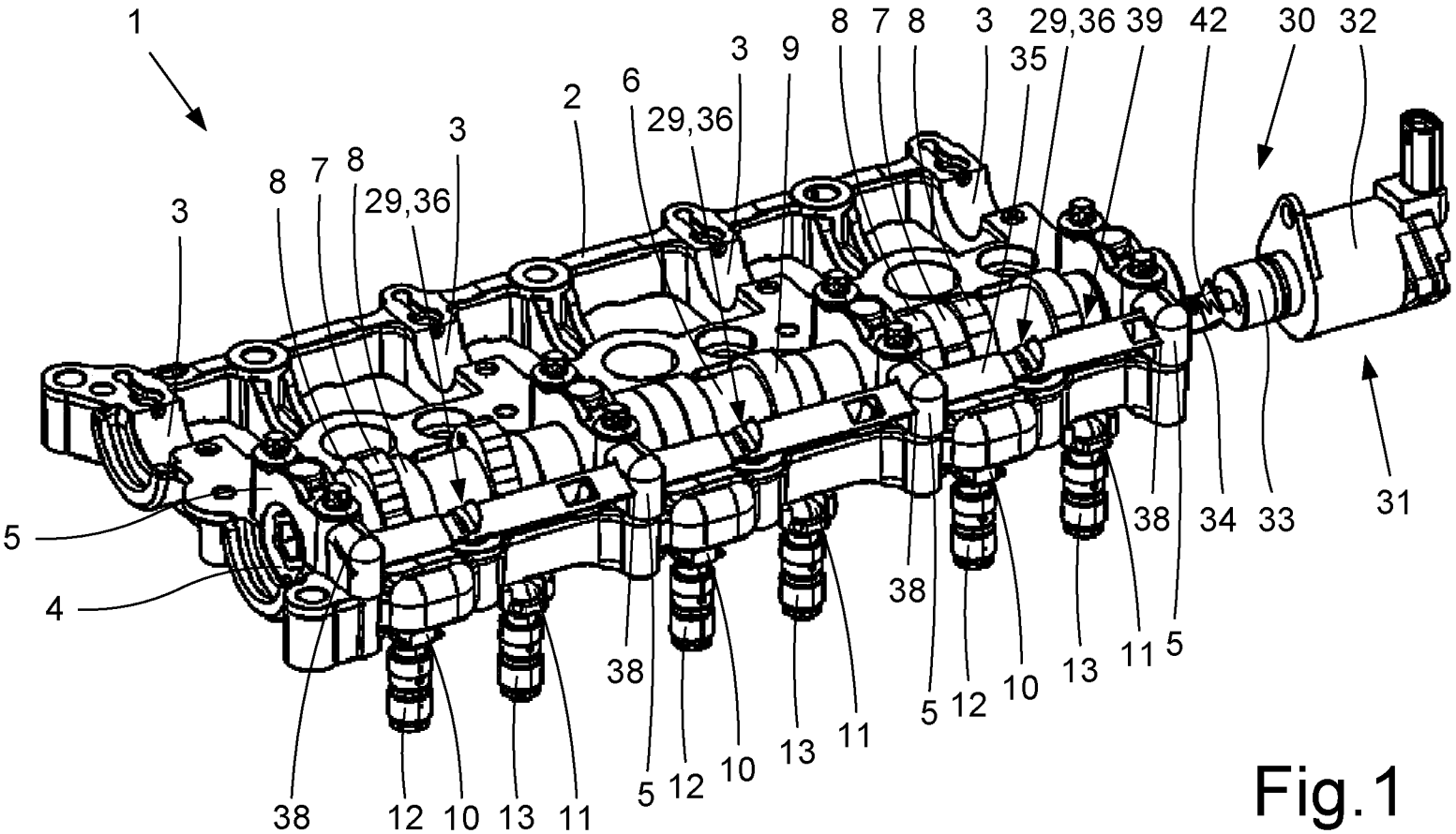
FIG. 1 shows an embodiment of an inventive valve train of a reciprocating internal combustion engine having three cylinders and four gas exchange valves for each cylinder with three switchable cam followers in the non-switched-over state in a perspective overview.

In the perspective overview of FIG. 1, a valve train 1 of a reciprocating internal combustion engine is shown with three cylinders arranged in series and two intake valves and two exhaust valves for each cylinder, but only to the extent required to explain the invention. A camshaft carrier 2 of a two-part cylinder head of the reciprocating internal combustion engine has four semi-circular first slide bearing portions 3 for mounting an intake camshaft (not shown) and four semi-circular second slide bearing portions 4 for mounting an exhaust camshaft 6. The remaining slide bearing portions for mounting the intake camshaft and the exhaust camshaft 5 are each a constituent part of bearing covers 5, which are fitted on the camshaft carrier 2 and screw-connected thereto after the insertion of the camshafts. Only the bearing covers 5 of the exhaust camshaft 6 are shown in FIG. 1.

Whilst the first exhaust valves (not shown) of each cylinder can be switched over in terms of their transferrable lift characteristic via associated switchable cam followers 10, non-switchable cam followers 11 are associated with the second exhaust valves (likewise not shown) of each cylinder for a constant lift transfer. To this end, the exhaust camshaft 6 for the first exhaust valves has, in each case, a centrally arranged primary cam 7 and two secondary cams 8 arranged on both sides of the primary cam 7. On the other hand, for the second exhaust valves, the exhaust camshaft 6 has only a single cam 9 in each case.

At their underside, the non-switchable cam followers 11 (not illustrated in more detail) are each supported at one end on a supporting element 13 mounted on the housing side with an integrated hydraulic valve-lash compensation element (HVA) and, at their other end, on the valve shaft of the associated second exhaust valve. Moreover, between these two ends, they are each in following contact with the associated cam 9 on their upper side. Upon a rotation of the exhaust camshaft 6, the lift characteristic of the relevant cam 9 is therefore transferred to the second exhaust valves via the non-switchable cam follower 11.

Figure 1A:
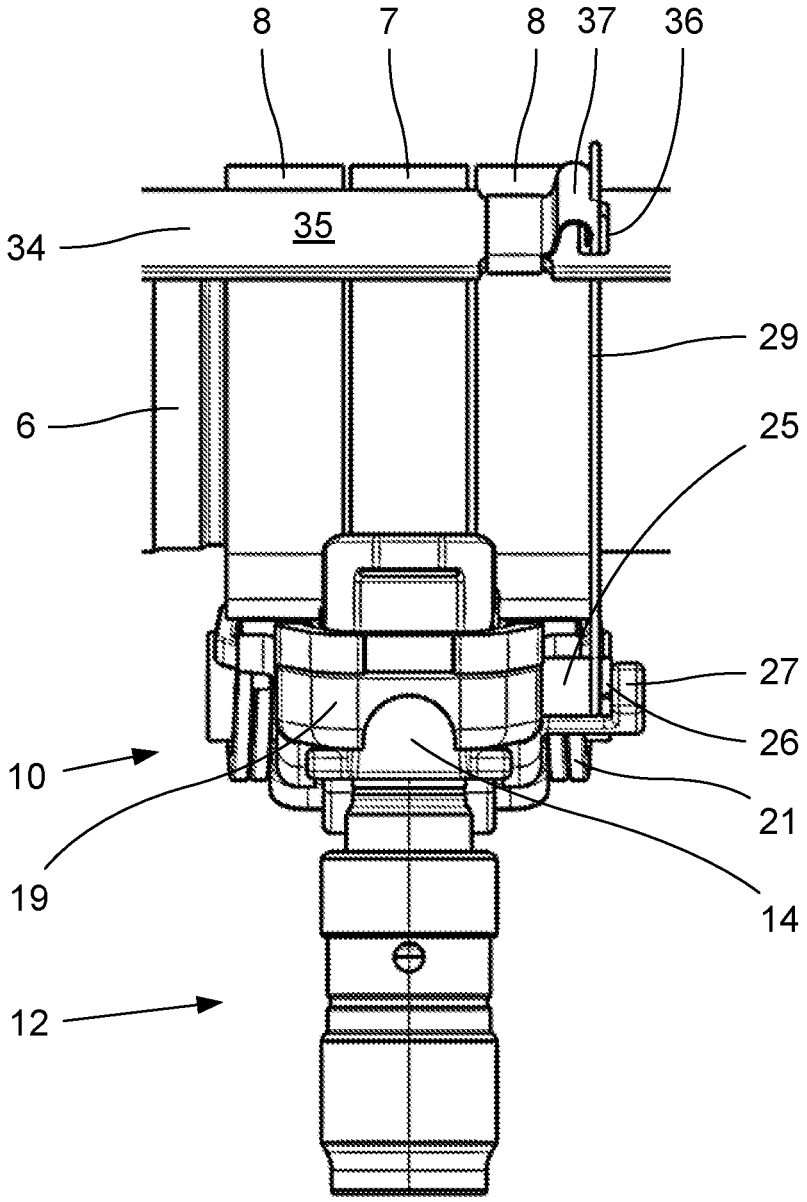
FIG. 1*a* shows a detail of the valve train according to FIG. 1 with a longitudinal view of a switchable cam follower in the non-switched-over state.
Figure 1B:
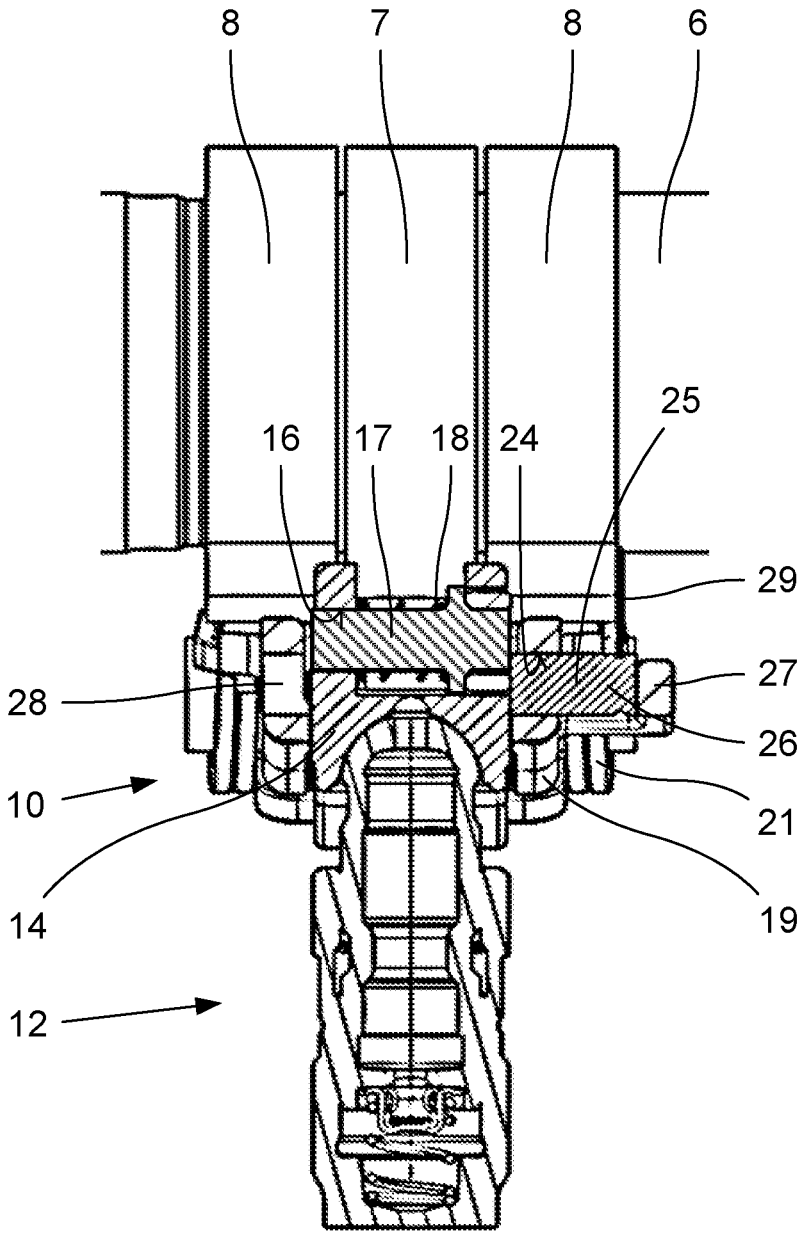
FIG. 1*b* shows a detail of the valve train according to FIG. 1 with a cross-sectional view of a switchable cam follower in the non-switched-over state.
Figure 1C:
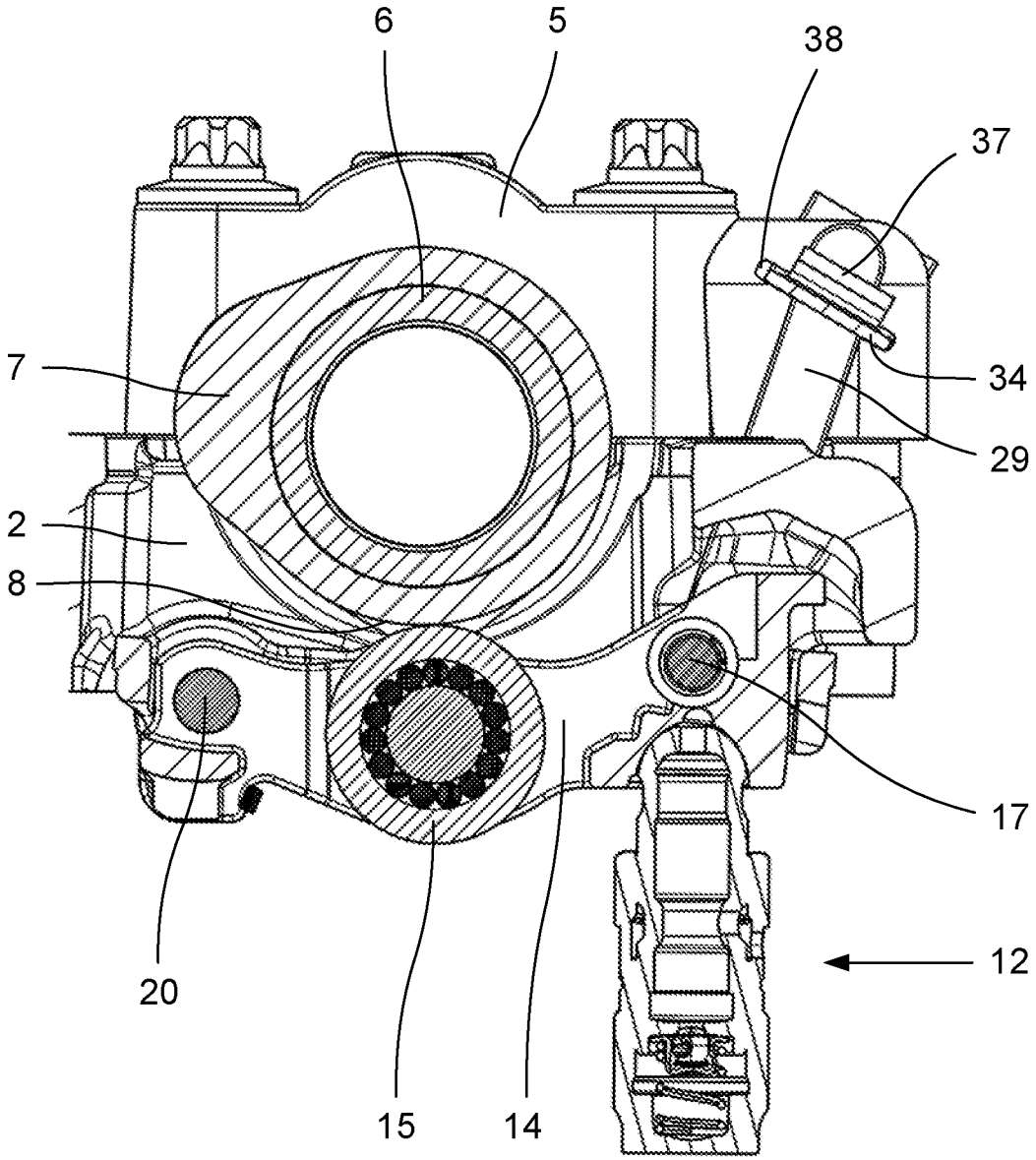
FIG. 1*c* shows a detail of the valve train according to FIG. 1 with a longitudinal sectional view of a switchable cam follower in the non-switched-over state.
Figure 3A:
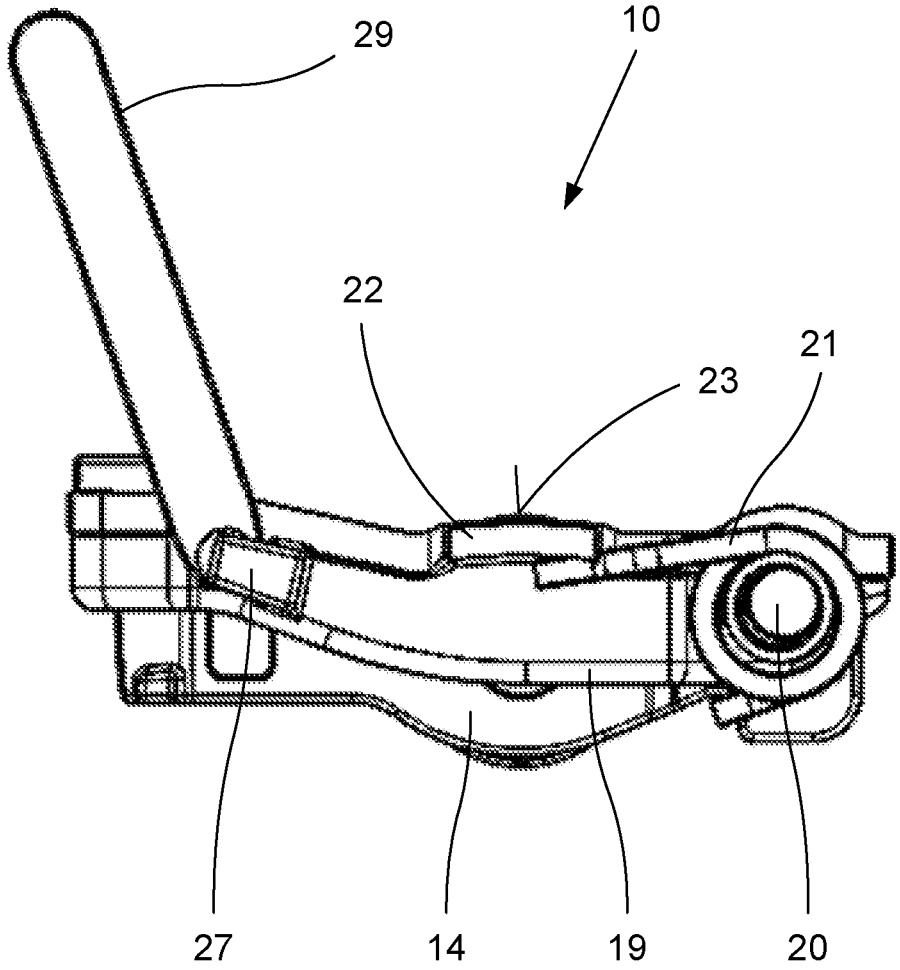
FIG. 3*a* shows a switchable cam follower of the valve train according to FIGS. 1 to 2*b* in a side view.
Figure 3B:
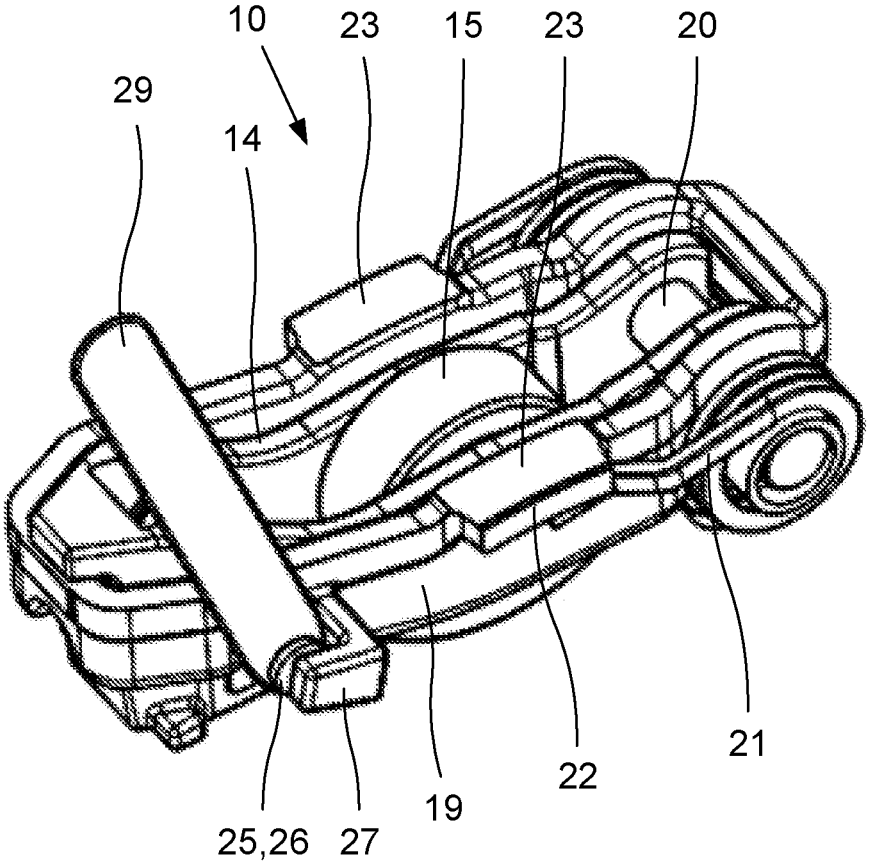
FIG. 3*b* shows the switchable cam follower of the valve train according to FIGS. 1 to 2*b* in a perspective angled view from above.

As can be seen in the longitudinal, cross-sectional and longitudinal sectional views of FIG. 1*a* to FIG. 1*c* and in the side view of FIG. 3*a* and in the perspective angled view of FIG. 3*b*, the switchable cam followers 10 each have a primary lever 14 and a secondary lever 19. The primary lever 14 is substantially designed in the form of a frame and, on its underside, is supported at one end on a supporting element 12 mounted on the housing side with an integrated hydraulic valve-lash compensation element (HVA) and, at its other end, on the valve shaft of the associated first exhaust valve.

On its upper side, the primary lever 14 is in following contact with an associated primary cam 7 via a follower element 15 which, in the present case, is formed as a rotatably mounted roller. The secondary lever 19 is configured in the form of a frame reaching around the primary lever 14 and is pivotably mounted on the primary lever 14 via a joint pin 20 arranged on the valve side. As shown in particular in FIGS. 3*a* and 3*b*, the secondary lever 19 has, as a follower element 22, a respective widened web portion on both sides with respect to its longitudinal extent, each having an outer slide surface 23 which, owing to the spring force of a pressure spring 21 formed as a leg spring, are in following contact with the associated secondary cams 8.

As a coupling element 17 for the form-fitting connection of the secondary lever 19 to the primary lever 14, a coupling pin is provided, which is axially movably guided in a transverse bore 16 of the primary lever 14 and is displaceable into an opposing coupling bore 28 of the secondary lever 19 in opposition to the restoring force of a spring element 18 formed as a helical spring via a switching pin 25, which is axially movably mounted in a transverse bore 24 of the secondary lever 19. The switching pin 25 projects out of the secondary lever 19 with its outer axial end 26 and, at this end, is in adjusting communication with a switching rod 34 of an adjusting device 30 via an upwardly directed rod-shaped connecting element 29.

The connecting elements 29 of the switchable cam followers 10 are formed as leaf springs in the present case and, in the manner of how a retaining ring is secured to a groove, are each fastened on the associated switching pin 25. A bore of the connecting element 29, which is open at the ends, is seated in an annular groove formed at the axial end 26 of the switching pin 25.

To delimit the adjustment path of the respective switching pin 25 in the outward direction and to protect the connection of the switching pin 25 to the respective leaf spring 29, the secondary levers 19 each have a bracket 27 (shown particularly clearly in FIG. 3*b*) which encompasses the outer end 26 of the associated switching pin 25.

The switching rod 34 of the adjusting device 30 is arranged above the cam followers 10, 11 parallel to the exhaust camshaft 6 and, via a linear actuator 31, is longitudinally displaceable in opposition to the restoring force of a spring element 42 from a rest position 39 into a switching position 41. In the present case, the linear actuator 31 is formed by way of example as an electromagnet with an armature 33 which is axially movably guided in a coil body 32, wherein the armature 33 is rigidly connected to the switching rod 34.

In the present case, the switching rod 34 is formed as a flat rod, which is arranged parallel to the switching pins 25 of the switchable cam followers 10 and which is preferably produced as a stamped component from a steel sheet or light metal sheet. The switching rod 34 is axially movably guided in a plurality of guide openings 38 of the camshaft carrier 2, which are fixed in the housing and, in the present case, are arranged in the bearing covers 5 of the exhaust camshaft 6.

The connecting elements 29 of the switchable cam followers 10, which are formed as leaf springs, each engage with play in a slot-shaped opening 36 of the switching rod 34, whereof the transverse and longitudinal dimensions are greater than the respective thickness and width of these connecting elements 29. The connecting elements 29 can thus move with little wear in the openings 36 of the switching rod 34 during operation of the reciprocating internal combustion engine. Moreover, manufacturing tolerances in the arrangement of the openings 36 in the switching rod 34 and the switching rod 34 as a whole can thus be compensated in a simple manner by an increased adjustment path of the linear actuator 31. At its wider outer wall 35, which is remote from the cam followers 10, 11, the switching rod 34 is equipped with an arcuate spring clip 37 at each opening 36 on the switching-direction side, the free end of which spring clip projects into the relevant opening 36 for resiliently supporting the associated leaf spring 29 in the longitudinal direction. The leaf springs 29 are thus resiliently and longitudinally displaceably supported in the openings 36 of the switching rod 34, whereby the mechanical wear on the contact surfaces is reduced and the transfer of transverse forces to the switching pins 25 of the switchable cam followers 10 is prevented.

In FIG. 1, the switching rod 34 of the adjusting device 30 is shown in its rest position 39, in which the secondary levers 19 of the switchable cam followers 10 are uncoupled from the primary levers 14. This uncoupled switching state of a switchable cam follower 10, in which the coupling pin 17 is located completely within the transverse bore 16 of the primary lever 14, can be seen particularly clearly in the cross-sectional view of FIG. 1*b*. In the uncoupled state of the primary lever 14 and the secondary lever 19, upon a rotation of the exhaust camshaft 6, only the lift characteristic of the relevant primary cam 7 is transferred to the associated first exhaust valve via the primary lever 14 of the switchable cam follower 10. The lift characteristic of the relevant secondary cam 8 then only ensures a deflection of the secondary lever 19 with respect to the primary lever 14. This can be clearly seen in the longitudinal sectional view of FIG. 1*c*, in which the primary cam 7 of the exhaust camshaft 6 is currently followed on the base radius by the roller 15 of the primary lever 14 and the secondary cams 8 of the exhaust camshaft 6 are currently followed in the region of a secondary lift cam by the slide surfaces 23 of the web portions 22 of the secondary lever 19.

Figure 2:
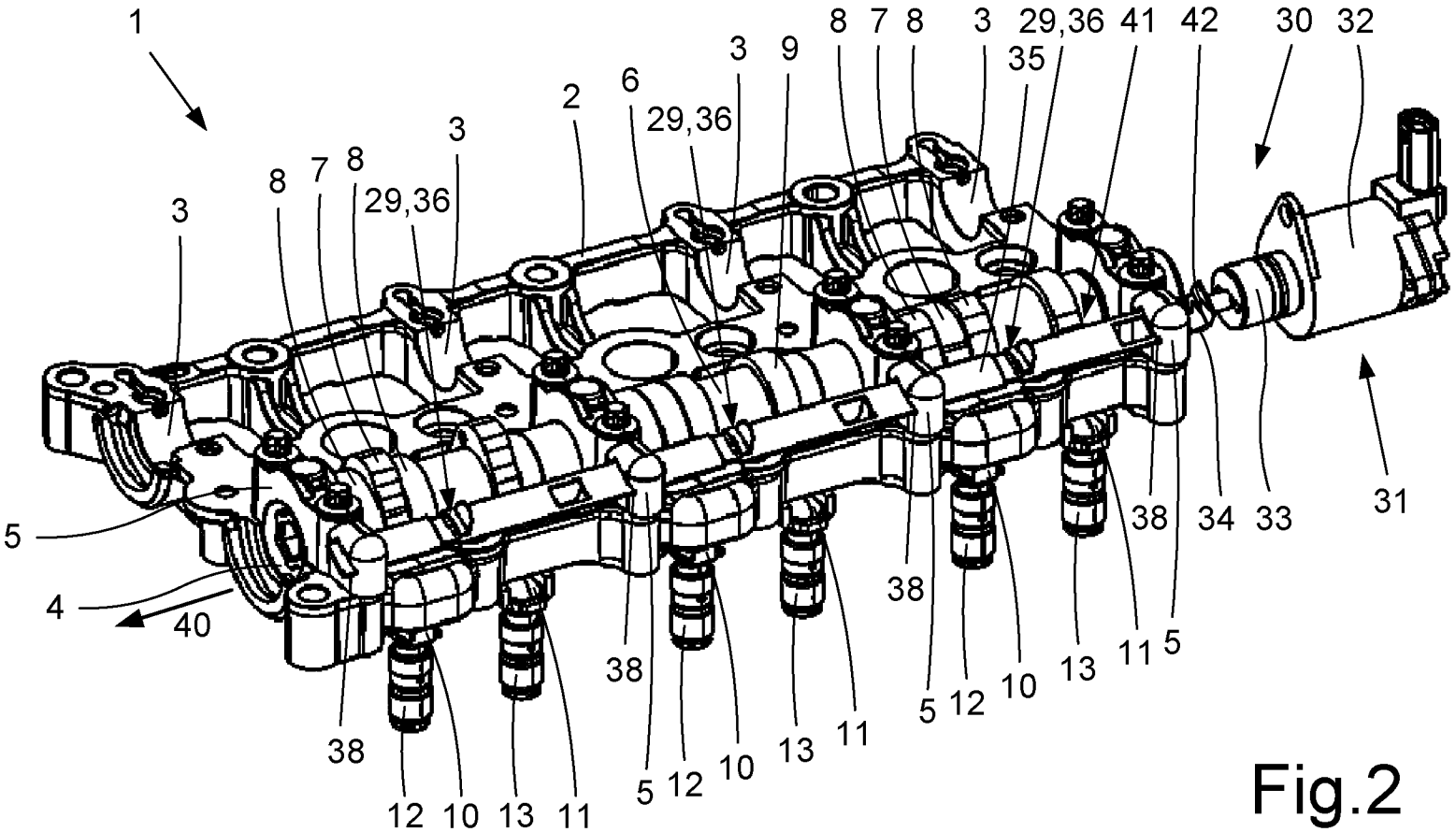
FIG. 2 shows the inventive valve train of a reciprocating internal combustion engine according to FIG. 1 with the three switchable cam followers in the switched-over state in a perspective overview.

In the perspective overview of FIG. 2, the switching rod 34 of the adjusting device 30 is shown in its switching position 41 into which it is displaced in the switching direction indicated by a direction arrow 40 as a result of an actuation of the linear actuator 31. In the switching position 41 of the switching rod 34, the coupling pins 17 of those cam followers 10 whereof the primary and secondary cams 7, 8 are currently followed on the base radius by the roller 15 of the primary lever 14 and the slide surfaces 23 of the web portions 22 of the secondary lever 19 are immediately displaced into the associated coupling bore 28 of the secondary lever 19 via the respective leaf spring 29 and the respective switching pin 25 since the transverse bore 24 and the coupling bore 28 of the secondary lever 19 are then flush with the transverse bore 16 of the primary lever 14. The secondary lever 19 of the relevant cam followers 10 are then coupled to the relevant primary lever 14 (see FIG. 2*b*).

In the case of those cam followers 10 whereof the primary or secondary cams 7, 8 are currently followed outside the base radius by the roller 15 of the primary lever 14 or the slide surfaces 23 of the web portions 22 of the secondary lever 19, only a pre-tensioning of the switching pins 25 in the switching direction 40 initially takes place via the leaf springs 29. The relevant coupling pins 17 are then displaced into the coupling bore 28 of the secondary lever 19 via the respective leaf spring 29 and the switching pin 25 as soon as their associated primary and secondary cams 7, 8 are followed on the base radius.

Figure 2A:
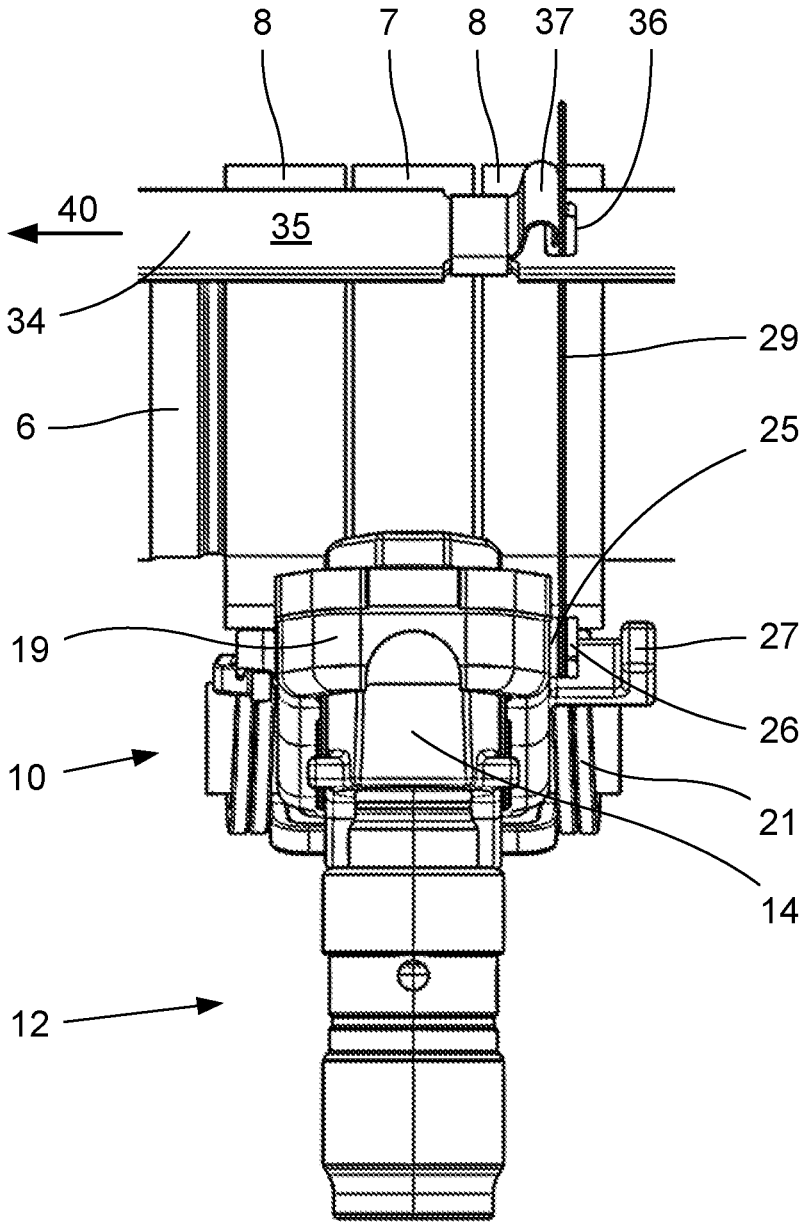
FIG. 2*a* shows a detail of the valve train according to FIG. 2 with a longitudinal view of a switchable cam follower in the switched-over state.
Figure 2B:
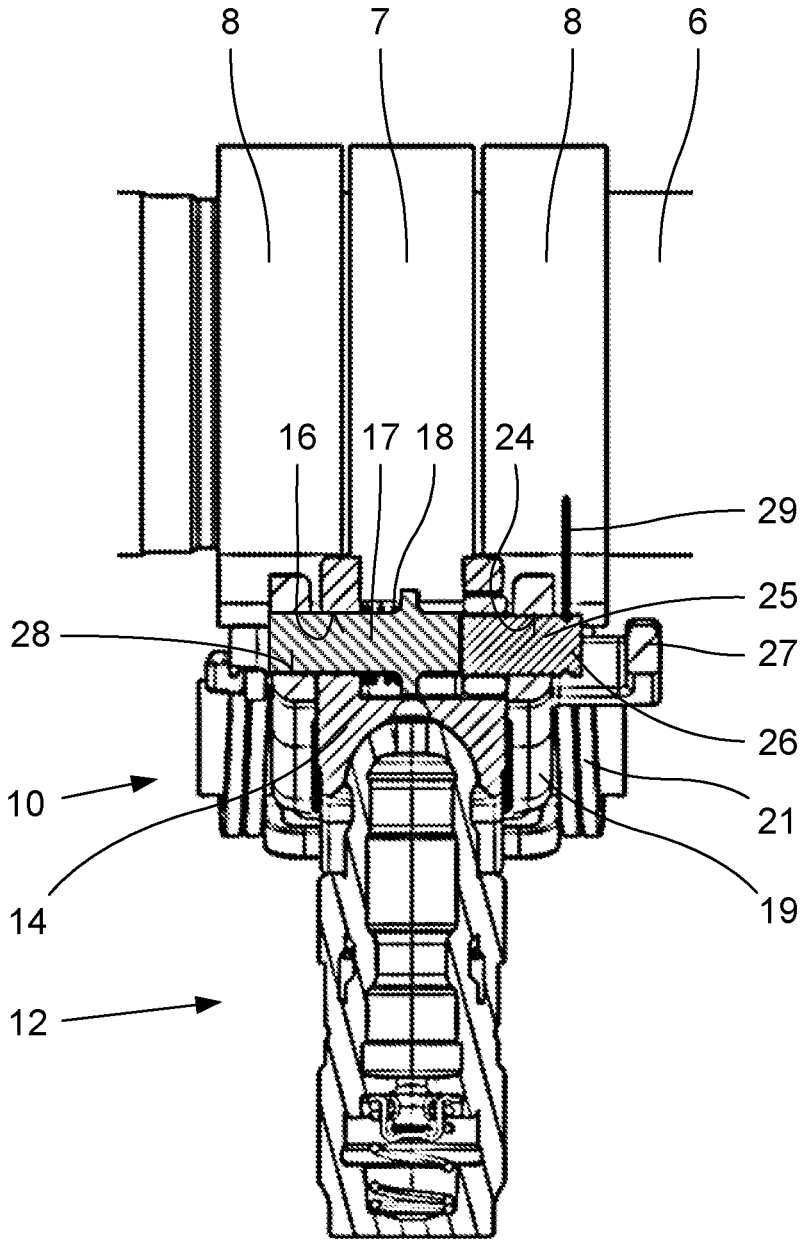
FIG. 2*b* shows a detail of the valve train according to FIG. 2 with a cross-sectional view of a switchable cam follower in the switched-over state.
Figure 2C:
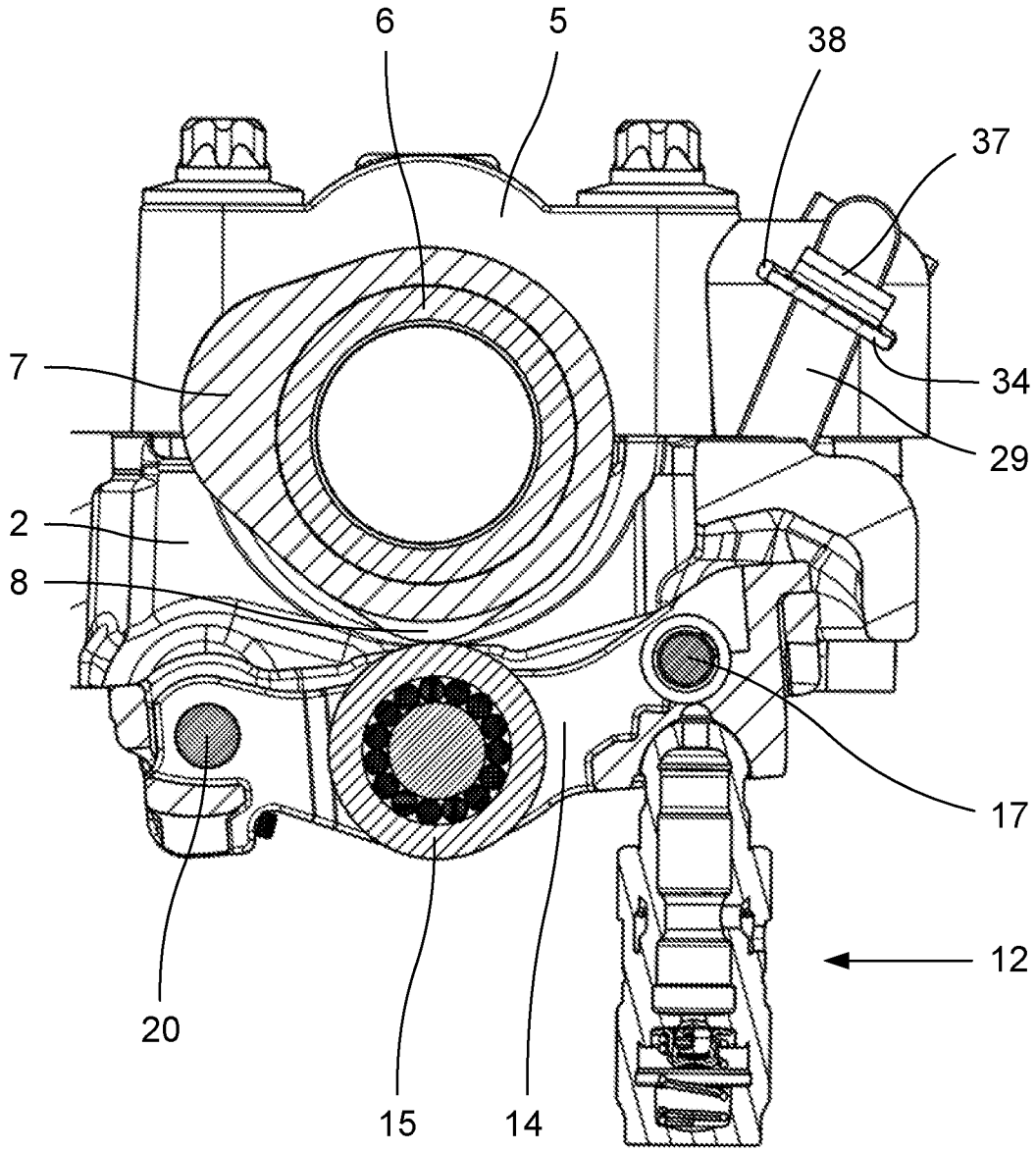
FIG. 2*c* shows a detail of the valve train according to FIG. 2 with a longitudinal sectional view of a switchable cam follower in the switched-over state.

This coupled switching state (also illustrated in the longitudinal view of FIG. 2*a*) of a switchable cam follower 10, in which the coupling pin 17 is located within the coupling bore 28 of the secondary lever 19, can be seen particularly clearly in the cross-sectional view of FIG. 2*b*. In the coupled state of the primary lever 14 and the secondary lever 19, upon a rotation of the exhaust camshaft 6, the respectively greater lift characteristic of the relevant primary cam 7 or the relevant secondary cams 8 is transferred to the associated first exhaust valve via the primary lever 14, or via the secondary lever 19 and the primary lever 14, of the switchable cam follower 10 respectively. This can be seen particularly clearly in the longitudinal sectional view of FIG. 2*c*, in which the primary cam 7 of the exhaust camshaft 6 is currently followed on the base radius by the roller 15 of the primary lever 14 and the secondary cams 8 of the exhaust camshaft 6 are currently followed in the region of a secondary lift cam by the slide surfaces 23 of the web portions 22 of the secondary lever 19.

In contrast to an adjusting arrangement with separate hydraulic or electromagnetic actuators in or on the cam followers, the adjusting device 30 according to the disclosure with the purely mechanically switchable cam followers 10 is designed in a significantly simpler and more space-saving manner and can be produced more cost-effectively.

LIST OF REFERENCE CHARACTERS

1 Valve train
2 Camshaft carrier
3 First slide bearing portion
4 Second slide bearing portion
5 Bearing cover
6 Exhaust camshaft
7 Primary cam
8 Secondary cam
9 Cam
10 Switchable cam follower
11 Non-switchable cam follower
12 Supporting element
13 Supporting element
14 Primary lever
15 Follower element, roller
16 Transverse bore
17 Coupling element, coupling pin
18 Spring element, helical spring
19 Secondary lever
20 Joint pin
21 Pressure spring, leg spring
22 Follower element, web portion
23 Slide surface
24 Transverse bore
25 Switching pin
26 Outer end
27 Bracket
28 Coupling bore
29 Coupling element, leaf spring
30 Adjusting device
31 Linear actuator, electromagnet
32 Coil body
33 Armature
34 Switching rod, flat rod
35 Wider outer wall
36 Opening
37 Spring clip
38 Guide opening
39 Rest position
40 Direction arrow, switching direction
41 Switching position
42 Spring element

The invention claimed is:

1. A variable valve train of a reciprocating internal combustion engine, the variable valve train comprising:

a switchable cam follower including:

a primary lever configured to be supported by a supporting element at a first end of the primary lever and by a valve stem of a gas exchange valve at a second end of the primary lever, the primary lever configured to be in following contact with at least one primary cam between the first end and the second end, and a secondary lever configured to be in following contact with at least one secondary cam, the second lever pivotally coupled to the primary lever via a coupling pin, wherein the coupling pin is axially movably guided in a transverse bore of the primary lever via a switching pin, the switching pin is axially movably mounted in a transverse bore of the secondary lever, the coupling pin configured to be displaced into an opposing coupling bore of the secondary lever in opposition to a restoring force of a first spring element, and wherein an outer axial end of the switching pin projects out of the secondary lever so as to connect to a leaf spring coupled to a switching rod, the switching rod arranged above the switchable cam follower and configured to extend parallel to a camshaft, the switching rod configured to be longitudinally displaced in opposition to a restoring force of a second spring element from a rest position to a switching position via an actuator.

2. The variable valve train as claimed in claim 1, wherein the actuator is formed as an electromagnet with an armature that is axially movably guided in a coil body and rigidly connected to the switching rod.

3. The variable valve train as claimed in claim 1, wherein the actuator is formed as a single-acting hydraulic or pneumatic adjusting cylinder with a piston which is axially movably guided in a cylinder, the piston connected to the switching rod.

4. The variable valve train as claimed in claim 1, wherein the switching rod is formed as a flat rod arranged parallel to the switching pin of the switchable cam follower.

5. The variable valve train as claimed in claim 4, wherein the switching rod is produced as a stamped component.

6. The variable valve train as claimed in claim 1, wherein a first end of the leaf spring is substantially rigidly fastened on the outer axial end of the switching pin, and a second end of the leaf spring engages a slot-shaped opening in the switching rod.

7. The variable valve train as claimed in claim 6, wherein the first end of the leaf spring includes a leaf spring bore, the leaf spring bore configured to engage an annular groove arranged at the outer axial end of the switching pin.

8. The variable valve train as claimed in claim 6, wherein a longitudinal dimension and a transverse dimension of the slot-shaped opening in the switching rod is greater than a respective width and thickness of the leaf spring.

9. The variable valve train as claimed in claim 8, wherein the switching rod is configured with an arcuate spring clip that is received by the slot-shaped opening.

10. The variable valve train as claimed in claim 1, wherein the switching rod is axially movably guided in a plurality of guide openings of a cylinder head, and at least one guide opening of the plurality of guide openings is arranged in a bearing cover of the camshaft.

11. A variable valve train configured for an internal combustion, the variable valve train comprising:

at least one switchable cam follower configured to be actuated by a camshaft, the at least one switchable cam follower including:

a primary lever;

a secondary lever, and, a coupling element configured to selectively couple the secondary lever to the primary lever, the coupling element comprising:

a coupling pin arranged to move within a first bore of the primary lever; and, a switching pin having an end protruding outside of a second bore of the secondary lever; and, a switching rod configured to actuate the coupling element; and at least one flexible leaf spring, wherein a first end of the at least one flexible leaf spring is configured to actuate the end of the switching pin, and a second end of the at least one flexible leaf spring extends to the switching rod, such that the first end is configured to be flexible relative to the second end in a direction parallel to the first bore of the secondary lever.

12. The variable valve train of claim 11, wherein the at least one flexible leaf spring is configured to provide a pre-tensioning force on the coupling element when the primary lever and the secondary lever cannot be coupled to one another.

13. The variable valve train of claim 11, wherein the second end of the at least one flexible leaf spring is resiliently supported in a longitudinal direction of the switching rod by a switching rod spring.

14. The variable valve train of claim 13, wherein the second end of the at least one flexible leaf spring engages a slot-shaped opening in the switching rod.

15. The variable valve train of claim 11, wherein the first end of the at least one flexible leaf spring is coupled to the end of the switching pin.

16. The variable valve train of claim 15, wherein the first end of the at least one flexible leaf spring engages an annular groove arranged at the end of the switching pin.

17. The variable valve train of claim 11, wherein the switching rod is configured to be arranged parallel to the camshaft.

18. The variable valve train of claim 11, wherein the primary lever is configured to be actuated by at least one primary cam, and the secondary lever is configured to be actuated by at least one secondary cam.

19. The variable valve train of claim 11, wherein the first bore is a transverse bore of the primary lever, and the second bore is a transverse bore of the secondary lever.

20. The variable valve train of claim 11, wherein the at least one switchable cam follower includes a plurality of switchable cam followers, and the at least one flexible leaf spring includes a plurality of leaf springs respectively arranged to actuate the plurality of switchable cam followers.

* * * * *